US006670937B1

(12) United States Patent
Tsuboyama et al.

(10) Patent No.: US 6,670,937 B1
(45) **Date of Patent: *Dec. 30, 2003**

(54) LIQUID CRYSTAL DISPLAY APPARATUS

(75) Inventors: Akira Tsuboyama, Sagamihara (JP); Yukio Hanyu, Isehara (JP); Koichi Sato, Atsugi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/515,609

(22) Filed: Feb. 29, 2000

(30) Foreign Application Priority Data

Mar. 1, 1999 (JP) ..... 11-053009
May 14, 1999 (JP) ..... 11-134127

(51) Int. Cl.[7] ..... G09G 3/36

(52) U.S. Cl. ..... 345/97

(58) Field of Search ..... 345/94–101, 87, 345/89; 359/63

(56) References Cited

U.S. PATENT DOCUMENTS

| | | | | |
|---|---|---|---|---|
| 4,674,839 A | | 6/1987 | Tsuboyama et al. | 350/334 |
| 4,712,877 A | | 12/1987 | Okada et al. | 350/350 |
| 4,902,107 A | | 2/1990 | Tsuboyama et al. | 350/350 S |
| 5,026,144 A | | 6/1991 | Taniguchi et al. | 350/350 |
| 5,033,822 A | | 7/1991 | Ooki et al. | 350/331 T |
| 5,041,821 A | | 8/1991 | Onitsuka et al. | 340/784 |
| 5,058,994 A | | 10/1991 | Mihara et al. | 359/56 |
| 5,082,352 A | * | 1/1992 | Kawagishi et al. | 359/63 |
| 5,109,294 A | | 4/1992 | Hanyu et al. | 359/83 |
| 5,124,820 A | | 6/1992 | Tsuboyama et al. | 359/56 |
| 5,233,447 A | | 8/1993 | Kuribayashi et al. | 359/56 |
| 5,276,542 A | | 1/1994 | Iwayama et al. | 359/86 |
| 5,293,544 A | | 3/1994 | Hanyu et al. | 359/78 |
| 5,321,419 A | | 6/1994 | Katakura et al. | 345/97 |
| 5,353,137 A | | 10/1994 | Tsuboyama et al. | 359/56 |
| 5,506,601 A | | 4/1996 | Mihara et al. | 345/103 |
| 5,523,872 A | | 6/1996 | Hanyu et al. | 359/78 |
| 5,583,534 A | | 12/1996 | Katakura et al. | 345/97 |
| 5,592,191 A | | 1/1997 | Tsuboyama et al. | 345/97 |
| 5,602,562 A | | 2/1997 | Onitsuka et al. | 345/101 |
| 5,606,343 A | | 2/1997 | Tsuboyama et al. | 345/97 |
| 5,627,559 A | | 5/1997 | Tsuboyama et al. | 345/97 |
| 5,673,062 A | | 9/1997 | Katakura et al. | 345/95 |
| 5,691,740 A | | 11/1997 | Onitsuka et al. | 345/96 |
| 5,734,367 A | | 3/1998 | Tsuboyama et al. | 345/101 |
| 5,742,369 A | | 4/1998 | Mihara et al. | 349/123 |
| 5,796,381 A | | 8/1998 | Iwasaki et al. | 345/101 |
| 5,808,594 A | | 9/1998 | Tsuboyama et al. | 345/89 |
| 5,815,133 A | | 9/1998 | Tsuboyama et al. | 345/95 |
| 5,886,678 A | | 3/1999 | Katakura et al. | 345/94 |

(List continued on next page.)

FOREIGN PATENT DOCUMENTS

JP 07-097192 4/1995

*Primary Examiner*—Steven Saras
*Assistant Examiner*—Srilakshmi K. Kumar
(74) *Attorney, Agent, or Firm*—Fitzpatrick, Cella, Harper & Scinto

(57) ABSTRACT

A liquid crystal display apparatus is constituted by a liquid crystal device comprising a pair of substrates each having thereon an electrode and a liquid crystal disposed between the pair of substrates and providing a tilt angle, driving voltage application means for applying a driving voltage to the liquid crystal, and at least one polarizer having a polarizing axis. The liquid crystal has a voltage-dependent alignment characteristic such that the tilt angle continuously changes depending on the driving voltage applied to the liquid crystal, and the above at least one polarizer is disposed so that the polarizing axis is shifted from positions providing a maximum transmittance and minimum transmittance under application of no electric field to increase the resultant transmittance and contrast.

8 Claims, 5 Drawing Sheets

U.S. PATENT DOCUMENTS 5,894,297 A 4/1999 Mizutome et al. ..... 345/99
5,956,010 A 9/1999 Asao et al. ..... 345/94
5,963,190 A 10/1999 Tsuboyama et al. ..... 345/103
5,995,076 A 11/1999 Tsuboyama et al. ..... 345/97
5,999,157 A 12/1999 Ito et al. ..... 345/94
6,016,133 A * 1/2000 Nito et al. ..... 345/89
6,028,579 A 2/2000 Tsuboyama et al. ..... 345/97
6,037,920 A * 3/2000 Mizutome et al. ..... 345/87

* cited by examiner

LIQUID CRYSTAL DISPLAY APPARATUS

BACKGROUND OF THE INVENTION

The present invention relates to a liquid crystal display apparatus capable of effecting high-speed display with a high contrast.

Almost all the commercially available active matrix-type displays utilize a TN (twisted nematic)-mode using a nematic liquid crystal.

However, a liquid crystal display device using such a TN-mode is accompanied with difficulties such as a low response speed (e.g., a large response time of several ten msec to several hundred msec) and a poor viewing-angle characteristic, thus resulting in inferior image qualities.

In order to overcome these difficulties, high-speed liquid crystal devices have been studied and proposed. As a representative example thereof, liquid crystal devices using a ferroelectric liquid crystal or an anti-ferroelectric liquid crystal have been developed. By using these liquid crystal devices, it is possible to realize a high-speed responsiveness (several ten psec to several hundred $\mu$sec) and a wider viewing angle. These liquid crystal devices are proposed, e.g., by T. Yoshida et al., "A full-color thresholdless Antiferroelectric LCD exhibiting wide viewing angle with fast response time", SID (Society for Information Display) 97 DIGEST, p.841- or T. Saishu et al., "Voltage-holding properties of thresholdless antiferroelectric liquid crystals driven by active matrices", SID 96 DIGEST, p.703-.

A liquid crystal material used in these articles is a smectic liquid crystal showing thresholdless antiferroelectricity and used in combination with a pair of cross-nicol polarizers for optical modulation. One optical axis (an absorption axis or transmission axis) of (two optical axes of) the pair of polarizers is aligned with an (average) optical axis of (anti-ferroelectric or smectic) liquid crystal molecules placed in a state where no electric field is applied, i.e., an antiferroelectric alignment state. These optical axes are also aligned with a direction normal (perpendicular) to a smectic (molecular) layer extension direction (hereinbelow, referred to as a "layer normal direction").

When a liquid crystal device and the pair of cross-nicol polarizers are arranged in such a state, a positive-polarity electric field and negative-polarity electric field having an identical magnitude (as an absolute value) provide an identical optical state (response characteristic) when these electric fields are applied to the liquid crystal device. Accordingly, the above-described arrangement of the liquid crystal device and the polarizers is convenient for drive of the liquid crystal device with an AC driving waveform.

A transmittance T (%) of a liquid crystal device is represented by the following formula:

$$T(\%) \propto \sin^2(2\theta),$$

wherein $\theta$ denotes an angle formed between an optical axis of (two optical axes) of a pair of polarizers and an (average) optical axis of a liquid crystal.

As apparent from the above formula, in order to provide a maximum transmittance, a condition of $\theta$=45 degrees is required but the antiferroelectric liquid crystal material generally provides $\theta$=30–35 deg. as also described in the above-mentioned articles. As a result, it is difficult to obtain the maximum transmittance in the above-described case where one of two optical axes is aligned with the layer normal direction of smectic liquid crystal molecules, thus resulting in a low contrast.

Incidentally, in order to develop a liquid crystal display device allowing smooth motion picture display, in addition to an increase in response speed of the liquid crystal material per se, studies from the viewpoint of human engineering have been promoted (e.g., K. Sueoka et al., "Improving the moving-image quality of TFT LCDs", International display research conference (IDRC) 1997, p. 203-).

According to this article, a CRT (cathode ray tube)-type display device is an impulsive light-emission display device for each frame period. On the other hand, a TFT (thin-film transistor)-type liquid crystal device is a light-quantity holding display device for holding a light quantity during each frame period. In view of smoothness of motion picture display, the former impulsive display allows smooth motion picture display due to response characteristics including an after light characteristic on human eyes but the latter light-quantity holding type display device is accompanied with less visibility of motion picture image, such as a double image phenomenon (a phenomenon such that the image is seen double by a viewer) since the afterlight in the preceding frame period still remains in human eyes in the current frame period. In order to realize the smooth display of motion picture image in the TFT-type liquid crystal device, one frame period is divided into two periods including a half (50%) display period and a half non-display period.

As described hereinabove, in the conventional liquid crystal display devices, a high-speed liquid crystal material such as the antiferroelectric liquid crystal is suitable for the TFT-type liquid crystal device allowing the motion picture display but provides a smaller tilt angle, thus failing to realize a sufficient transmittance. In order to obtain smooth motion picture image display in the TFT-type liquid crystal device, it is necessary to effect display with a timewise opening rate of about at most 50%.

SUMMARY OF THE INVENTION

In view of the above-mentioned problems of the conventional liquid crystal display devices, an object of the present invention is to provide a liquid crystal display apparatus providing not only a sufficient transmittance (transmitted light quantity) by using a liquid crystal (such as an antiferroelectric liquid crystal) showing a high-speed responsiveness and a wide viewing angle but providing a relatively small saturated tilt angle (below 45 deg.), but also a timewise opening rate of at most 50% for meeting motion picture display and a sufficient continuous image forming performance.

Another object of the present invention is to provide a liquid crystal display apparatus capable of providing a high-speed display with a high contrast.

According to the present invention, there is provided a liquid crystal display apparatus, comprising:

a liquid crystal device comprising a pair of substrates each having thereon an electrode and a liquid crystal disposed between the pair of substrates and providing a tilt angle, driving voltage application means for applying a driving voltage to the liquid crystal, and at least one polarizer having a polarizing axis, wherein said liquid crystal has a voltage-dependent alignment characteristic such that the tilt angle continuously changes depending on the driving voltage applied to the liquid crystal, and said at least one polarizer is disposed so that the polarizing axis is shifted from positions providing a maximum transmittance and minimum transmittance under application of no electric field.

According to the present invention, there is also provided a liquid crystal display apparatus, comprising:

a liquid crystal device comprising a pair of substrates each provided with an electrode and a liquid crystal disposed between the pair of substrates to form a plurality of pixels arranged in a matrix form, drive means for driving the liquid crystal device, and a pair of cross nicol polarizers disposed to sandwich the liquid crystal device, wherein the liquid crystal is an antiferroelectric liquid crystal which provides a thresholdless voltage-transmittance curve inherently assuming a V-character shape having a symmetry axis across a zero-voltage point if one of optical axes of the polarizers were aligned in a direction normal to molecular layers of the antiferroelectric liquid crystal, but said one of optical axes of the polarizers is actually set to form a prescribed angle with said direction normal to molecular layers thereby to provide an asymmetrical voltage-transmittance curve with respect to a line across a zero-voltage point, and said drive means comprises means for driving the liquid crystal device in alternately repeated display and non-display periods to compensate for a DC voltage component.

Herein, the term "tilt angle" refers to to an angle formed between an average molecular axis (optical axis) of the liquid crystal and the layer normal direction of the liquid crystal molecules.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
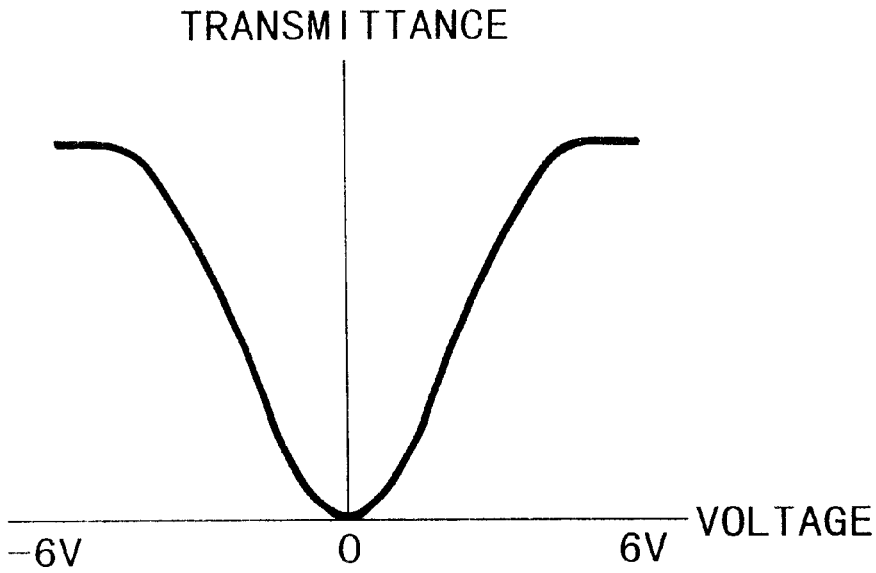
FIG. 1 is a graph showing an embodiment of a V-T (voltage-transmittance) curve of a thresholdless antiferroelectric liquid crystal under application of a triangular waveform voltage (0.1 Hz).

In the present invention, as a liquid crystal material, it is possible to use a smectic liquid crystal, such as an antiferroelectric liquid crystal or a ferroelectric liquid crystal, having an alignment characteristic such that a molecular alignment state thereof continuously changes depending on a voltage applied to the liquid crystal.

In conventional liquid crystal display apparatus, an optical axis (of two optical axes) of a pair of polarizers is aligned with an optical axis of a liquid crystal used under no electric field application. Accordingly, when a voltage is applied to the liquid crystal, an angle θ formed between the optical axis of the polarizers and that of the liquid crystal can provide at best a maximum tilt angle θmax, thus failing to provide a sufficiently large maximum transmittance.

In the present invention, the polarizer optical axis is intentionally shifted from the position in alignment with the liquid crystal optical axis under no electric field application so as to provide a prescribed shift (or deviation) angle (θB) from the liquid crystal optical axis. If the shift angle is set to −θB, the above-mentioned angle θ (between the polarizer optical axis and the liquid crystal optical axis under electric field application) can be increased up to θmax (maximum tilt angle) +θB, thus increasing a maximum transmittance when compared with the conventional liquid crystal device. Particularly, in the case where the maximum tilt angle θmax is at least 22.5 deg., by setting the shift angle θB to 45 deg. −θmax, the resultant angle θ can change continuously depending on the applied voltage value, thus allowing an optimum gradation drive.

In this case, however, the tilt angle of the liquid crystal largely depends upon an operation temperature, thus being liable to cause a fluctuation in contrast with a temperature change and an inferior color characteristic for color display. In the present invention, the liquid crystal device may preferably further include a temperature-detecting device for detecting a temperature of the liquid crystal panel (device) and a temperature-compensating means for changing a driving voltage supplied from a driving voltage application means depending on the detected temperature data, thus compensating for the change in temperature.

In the present invention, the anti-ferroelectric liquid crystal may preferably be used, hereby it is possible to provide a timewise opening rate of at most 50% effective for motion picture display and a sufficient continuous image forming performance in addition to a larger transmittance.

As another liquid crystal material used in the present invention, a ferroelectric liquid crystal having a monostability, such as a DHF (deformed helix ferroelectric) liquid crystal or a cholesteric liquid crystal allowing a ULH (uniform lying helix) mode wherein a helix axis is aligned in parallel with a substrate and a flexoelectric effect is utilized as a driving torque, as described by, e.g., Tanaka et al., "Full color DHF-AMLCD with Wide Viewing Angle", SID International Symposium Digest of Technical Papers, vol. XXV (1994), pp. 430–433 and Japanese Patent Publication (JP-B) No. 7-97192 (applicant: AT & T) may be applicable.

In a preferred embodiment of the present invention, in a liquid crystal display apparatus comprising a liquid crystal device including a pair of substrates each provided with an electrode and a liquid crystal disposed between the substrates so as to provide a plurality of pixels arranged in a matrix form, a driving voltage application means, at least one polarizer, a temperature-detecting device and a temperature-compensating means for changing the driving voltage based on temperature data detected by the temperature-detecting means; the liquid crystal has an alignment characteristic such that an alignment state of liquid crystal molecules changes continuously depending on a voltage (driving voltage) applied from the driving voltage application means to the liquid crystal to provide an asymmetrical V-T (applied driving voltage-transmittance or transmitted light quantity) curve with respect to the ordinate (the vertical line across the origin (V=T=0)) and the driving voltage is changed and controlled by the temperature-compensating means depending on the detected temperature.

Hereinbelow, a specific and preferred example of the liquid crystal display apparatus of the present invention will be described.

A liquid crystal panel (device) (as a single-pixel test cell) was prepared in the following manner.

Each of two glass substrates provided with a 70 nm-thick ITO (indium tin oxide) electrode (electrode area: 0.9 $cm^2$) was coated with a 70 nm-)thick thick polyimide film by applying a solution of a polyimide precursor ("LP-64", mfd. by Toray K.K.) by spin coating at 1000 rpm and curing the coating at 200° C. for 1 hour, followed by rubbing treatment (uniaxial aligning treatment) with a nylon (rubbing) cloth in one direction under the rubbing conditions (roller diameter: 80 mm, rotating speed: 1000 rpm, substrate feed speed: 50 mm/sec, pressing depth: 0.3 mm) and then washing with isopropyl alcohol and water. One of the substrates, 1.5 $\mu$m-dia. silica beads were dispersed and the pair of substrates was applied to each other via an adhesive disposed at the periphery of the substrates (other than the electrode portion) so that two rubbing treatment axes are parallel but oppositely directed (anti-parallel) to provide a blank cell having a cell gap of 1.5 $\mu$m.

Into the cell gap, a chiral smectic (antiferroelectric) liquid crystal composition having properties shown below was injected at an isotropic liquid temperature by utilizing the capillary action to provide a liquid crystal device (test cell).

Phase transition temperatures (° C.)

$$\text{Iso.} \xrightarrow{80} \text{SmA} \xrightarrow{70} \text{SmCA*} \xrightarrow{<0} \text{Cryst.}$$

Spontaneous polarization (at 30° C., triangular method): 210 $nC/cm^2$

Cone angle 2θ (at 30° C.): 60 deg. (corre. to tilt angle θ: 30 deg.)

When the liquid crystal device was supplied with a triangular waveform voltage (0.1 Hz), the liquid crystal composition provided a V-T curve as shown in FIG. 1.

Figure 2:
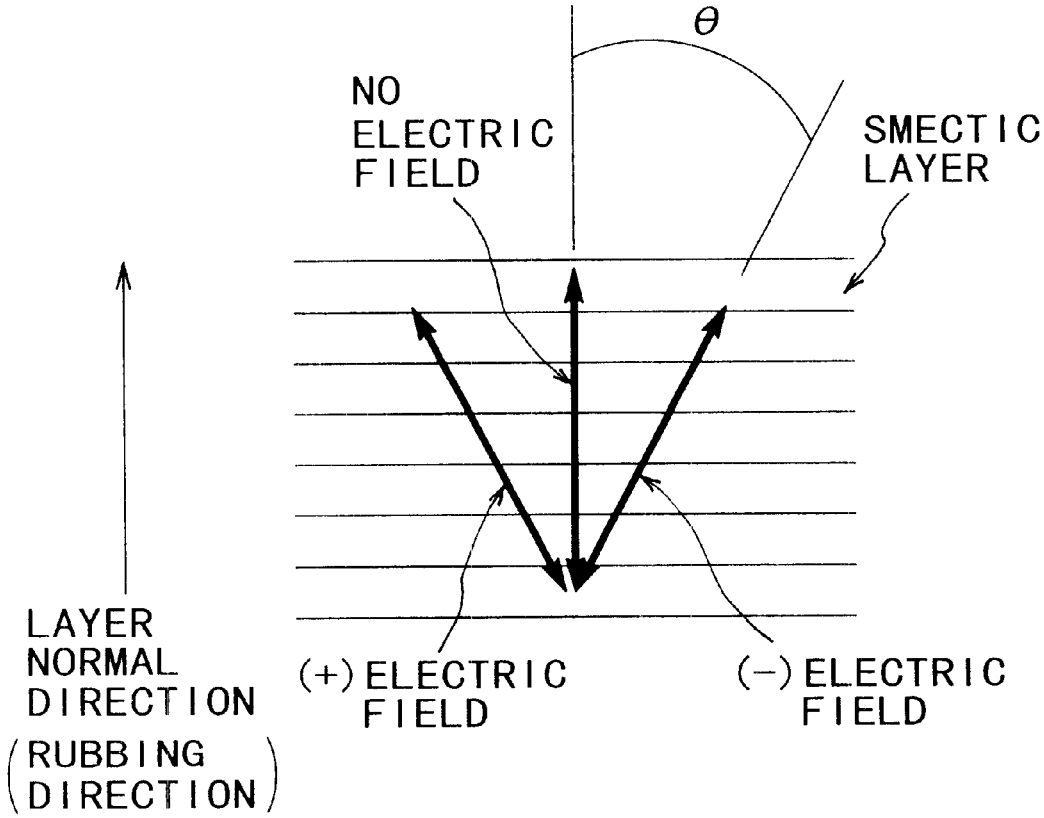
FIG. 2 is a schematic view for illustrating a switching behavior of the antiferroelectric liquid crystal.

In this instance, the liquid crystal composition shows a switching behavior (molecular alignment states varying depending on the applied voltage) as shown in FIG. 2.

Referring to FIG. 2, an optical axis of each smectic liquid crystal molecule indicated by the arrow is directed in a direction normal to smectic molecular layers (layer normal direction) when an electric field is not applied and under application of positive (+) or negative (−) electric field, is symmetrically tilted or shifted from the layer normal direction and settled at a voltage of at least a saturation voltage value at extreme positions indicated by the arrows, respectively, shown in the figure.

The V-T curve of the liquid crystal composition shown in FIG. 1 is obtained in the case where one of a pair of cross-nicol polarizers is disposed so that its optical axis is aligned with the layer normal direction of the smectic molecular layers shown the FIG. 2.

Figure 3A:
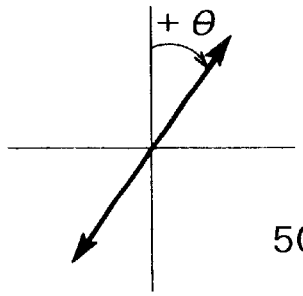
FIG. 3B is a graph showing a temperature dependence of a tilt angle (θ) of the antiferroelectric liquid crystal under application of various voltages on condition that the direction (sign) of the tilt angle (θ) is taken as shown in FIG. 3A.
Figure 3B:
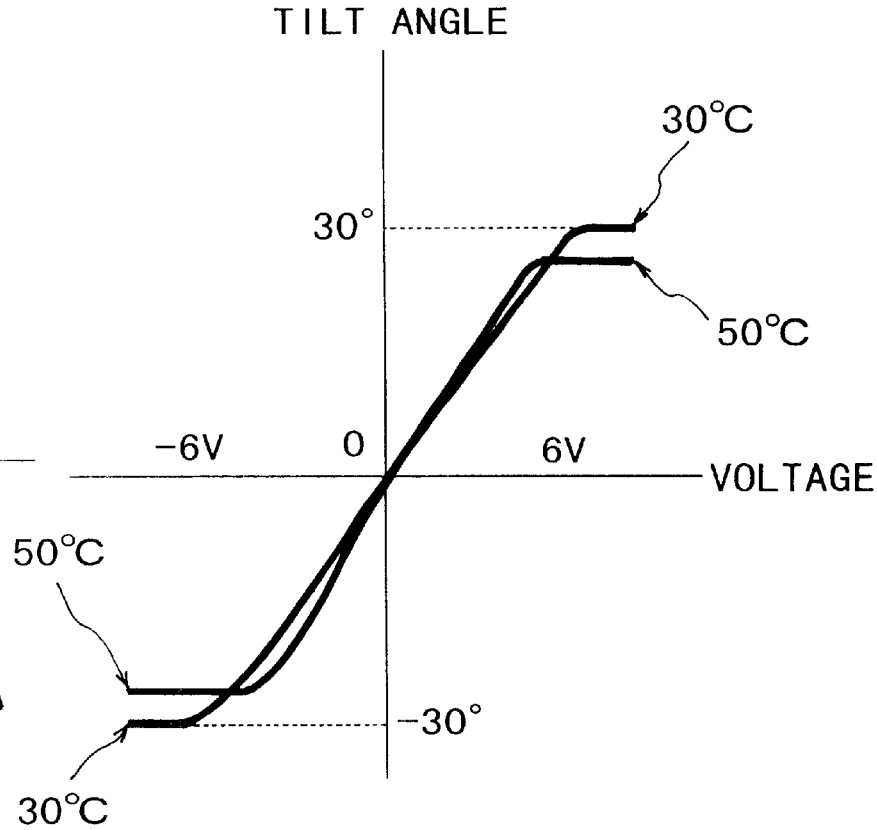

FIG. 3 is a graph showing tilt angle-voltage curves at 30° C. and 50° C. As shown in FIG. 3, an anti-ferroelectric liquid crystal (composition) generally has a temperature-dependent tilt angle characteristic such that a saturation voltage (Vsat) and a saturation tilt angle (θsat) are decreased with an increasing temperature.

Specifically in this embodiment, the saturation voltages and tilt angles were as follows.

| Temp. (° C.) | Vsat (volts) | θsat (deg.) |
|---|---|---|
| 30 | 6.0 | 30 |
| 50 | 4.2 | 24 |

The above-prepared test cell (liquid crystal device) was placed in a temperature control apparatus and set to a polarizing microscope equipped with a pair of cross-nicol polarizers. The test cell was supplied with a voltage while changing its values to find the position of the test cell providing the darkest state based on the position and the relationship between the tilt angle and the applied voltage, the saturation voltages and tilt angles at the respective temperatures can be determined.

When such a test cell under the above conditions was supplied with a triangular waveform voltage (0.1 Hz) after one of the polarizer optical axes was set to provide a shift angle from the layer normal direction (rubbing direction) of +15 deg. (in a direction tilted clockwise), the liquid crystal composition placed in an alignment state providing an angle from the layer normal direction of −30 deg. (in a direction tilted counterclockwise) formed an angle between the liquid crystal (molecular) optical axis and the polarizer optical axis of 45 deg., thus providing a maximum transmittance (the largest transmitted light quantity).

Figure 4:
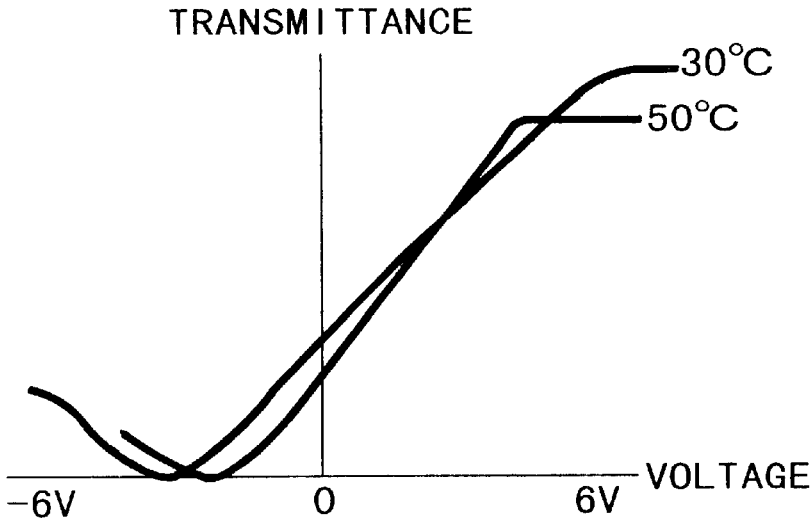
FIG. 4 is a graph showing V-T curves (at 30° C. and 50° C.) of the antiferroelectric liquid crystal on condition that one of polarizers is disposed to form an angle of 15 deg. with the average molecular (optical) axis of antiferroelectric liquid crystal molecules.

The results (V-T curves at 30° C. and 50° C.) are shown in FIG. 4.

As apparent from FIG. 4, the resultant V-T curves were different from each other due to the different temperatures.

If the liquid crystal device (test cell) is driven under the same driving conditions irrespective of the operation temperature, it is clear that a resultant contrast is lowered and sufficient gradation levels for dark (black) and bright (white) states cannot be ensured. In order to provide a sufficient contrast, the darkest state is required to provide a smaller luminance.

Figure 5:
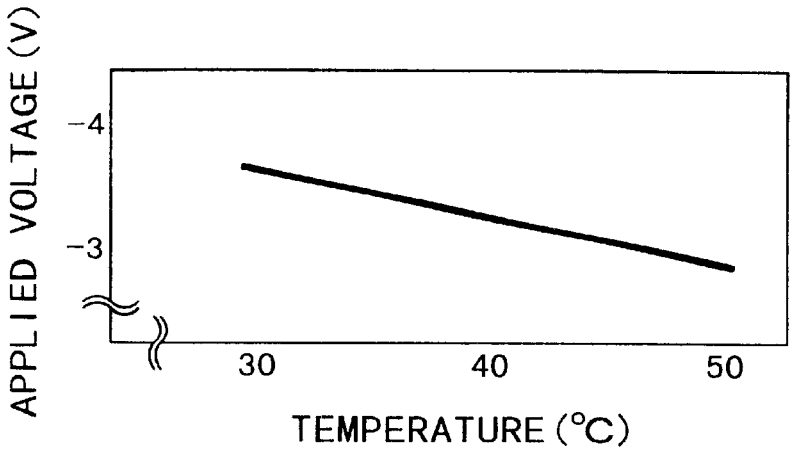
FIG. 5 is a graph showing a temperature dependence of the applied voltage (V) providing a minimum luminance under the condition with respect to FIG. 4.

FIG. 5 is a graph showing a relationship between a temperature and an applied voltage providing the minimum luminance voltage providing the minimum luminance in the case of using the liquid crystal device under the above-mentioned conditions providing the V-T curves shown in FIG. 4.

Based on the temperature-voltage relationship as shown in FIG. 5, in the present invention, the driving voltage waveform applied to the liquid crystal device may appropriately be controlled so that the applied voltage value for providing the darkest state at the operation temperature satisfies the relationship shown in FIG. 5.

Figure 6:
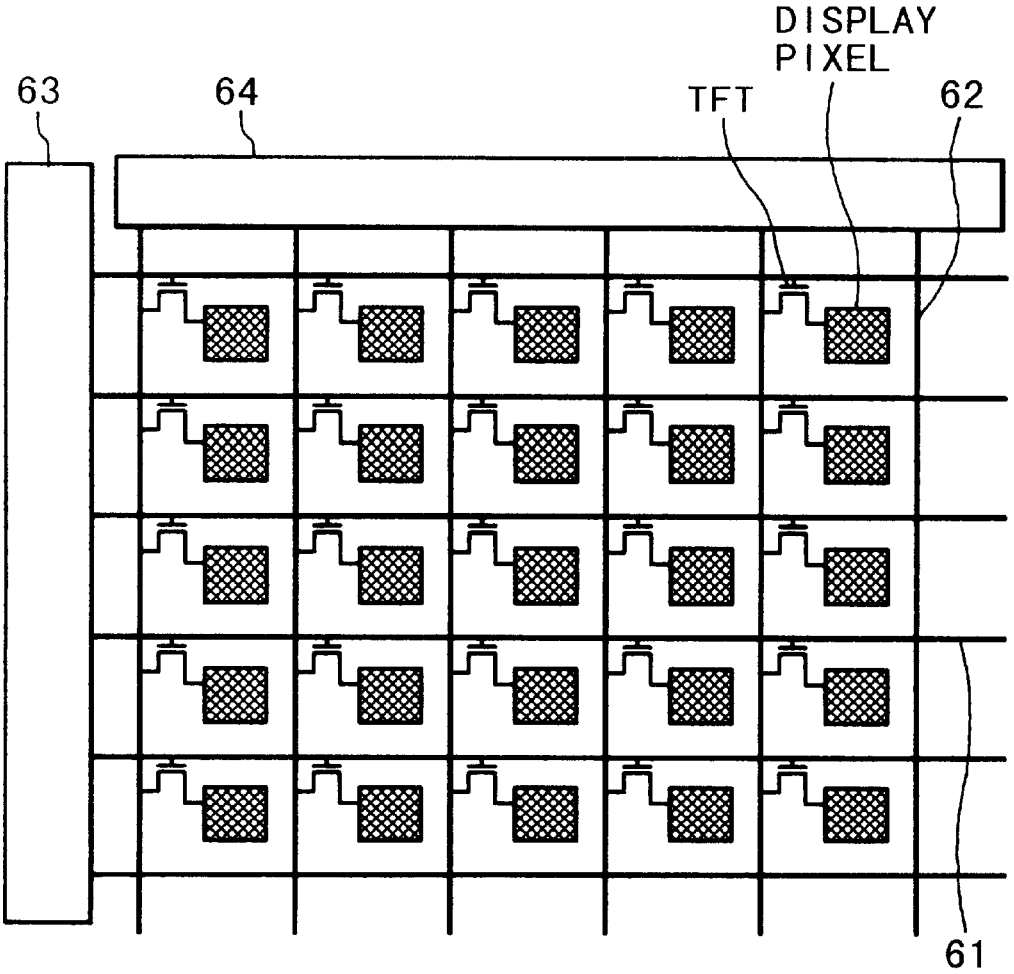
FIG. 6 is a schematic plan view of an embodiment of an active matrix-type liquid crystal display apparatus according to the present invention.

When the above-mentioned liquid crystal device of the present invention is utilized as an active matrix-type liquid crystal panel in combination with a TFT (thin film transistor), a liquid crystal display apparatus may preferably have a structure as shown in FIG. 6.

Referring to FIG. 6, the liquid crystal display apparatus includes an active matrix-type liquid crystal panel comprising a plurality of display pixels arranged in a matrix form, and a driving voltage application means including a gate driver 63 and a source driver 64.

Each display pixel is provided with a TFT and formed at each intersection of gate electrodes 61 and source electrodes 62 intersecting the gate electrodes 61. Each of the TFTs is connected with an associated gate electrode 61 and an associated source electrode 62.

Each display pixel is successively supplied with a gate-ON pulse from gate driver 61 via the gate electrode 61 and in synchronism therewith, is supplied with a prescribed driving voltage depending on image data from the source driver 64 via the source electrode 62.

Figure 7:
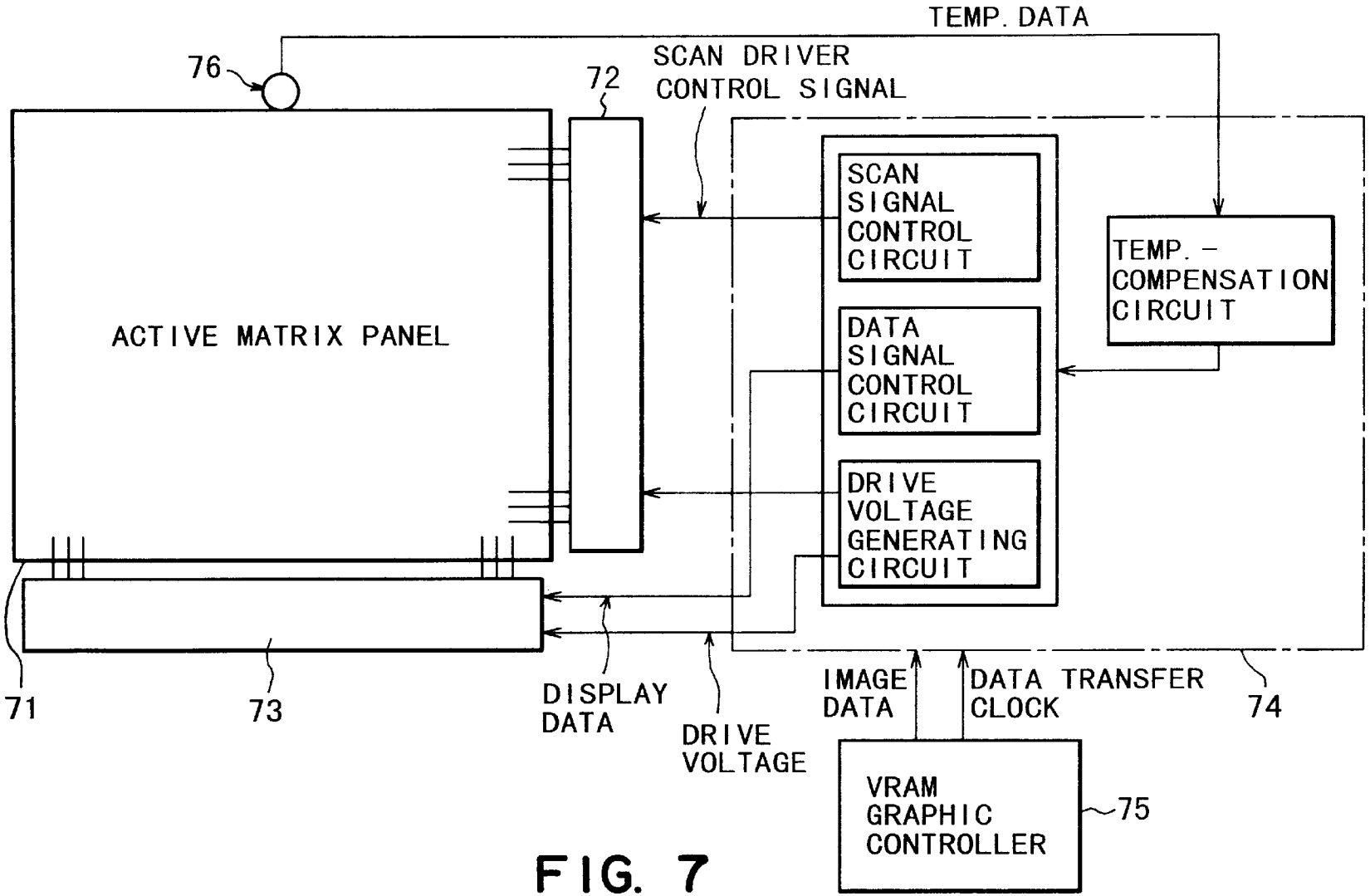
FIG. 7 is a block diagram of the liquid crystal display apparatus of the present invention shown in FIG. 6.

FIG. 7 is a block diagram of an embodiment of the liquid crystal display apparatus of the present invention.

Referring to FIG. 7, the liquid crystal display apparatus comprises a driving system including the active matrix-type liquid crystal panel (device) 71, a gate (scanning line) driver 72, a source (data line) driver 73, a controller 74 and a data generator 75.

The controller 74 includes a gate pulse (scanning line) signal control circuit for supplying a gate driver control signal to the gate driver 72, a data signal control circuit for supplying display data to the source driver 73, a driving voltage generating circuit for supplying a driving voltage to the source driver 73, and a temperature-compensating circuit for receiving temperature data from a temperature sensor 76 for detecting a temperature of the liquid crystal panel 71. Display data are generated in the data generator 75 including a VRAM (video-random-access memory) and a graphic controller and set to the controller 74.

The controller 74 determines driving conditions based on the temperature data from the temperature sensor 75, e.g., by using a ROM (read-only memory) that stores in memory a temperature-compensating table determining a driving condition corresponding to the detected temperature data. The temperature-compensating table is based on the temperature-voltage relationship as shown in FIG. 5. In order to effect display control that includes not only contrast data but also gradation data, the V-T curves shown in FIG. 4 may preferably be used in combination with the temperature-voltage curve shown in FIG. 5, thus modifying a dynamic range of the voltage applied to the liquid crystal used.

Figure 8:
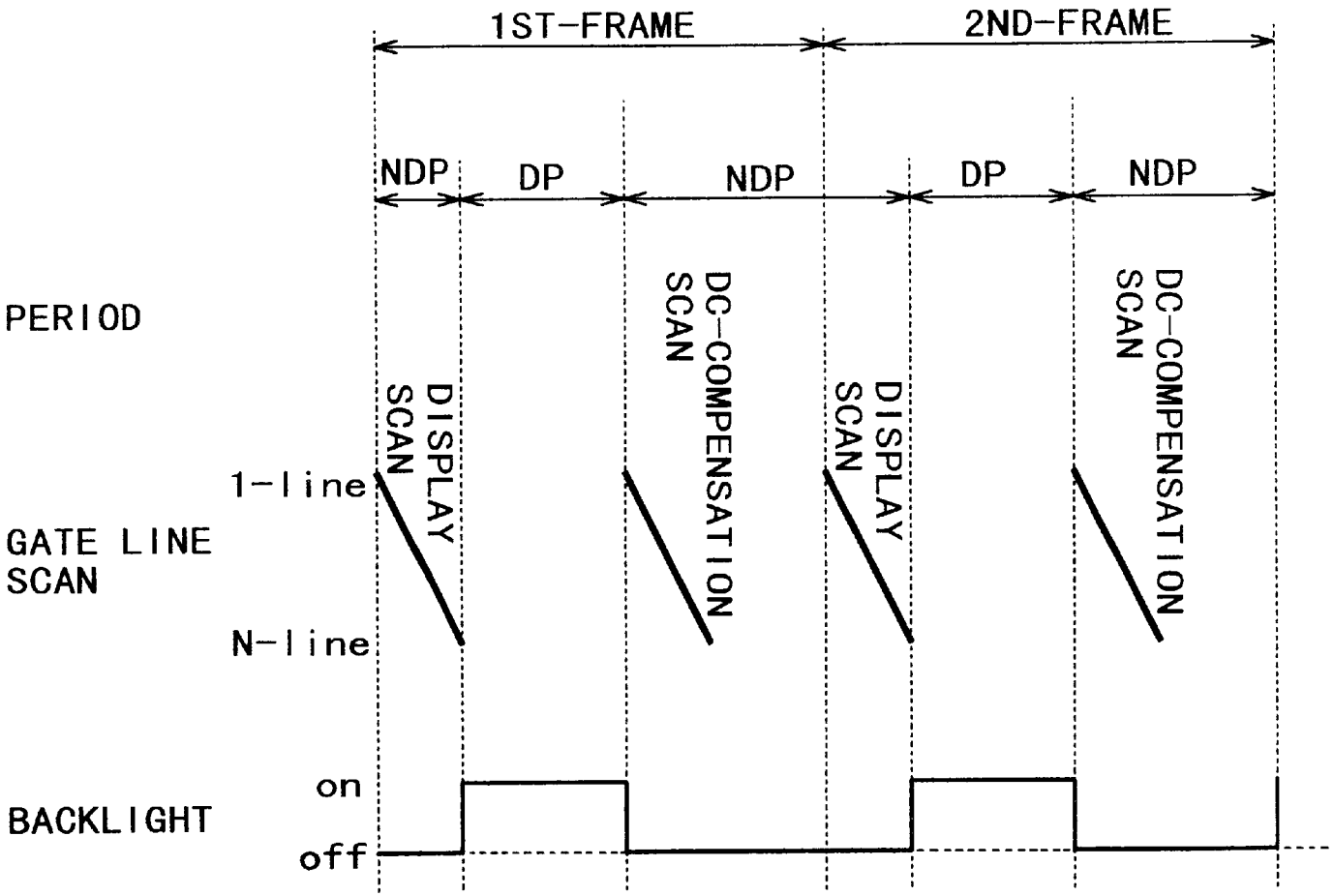
FIG. 8 is a time chart for illustrating a driving sequence of the display apparatus shown in FIG. 7 and a lightning state (lighting or non-lighting) of a backlight device.

FIG. 8 shows a driving sequence for the liquid crystal display apparatus shown in FIGS. 6 and 7 and a switching timing of lighting "ON" and "OFF", wherein a temperature opening rate is set to at most 50%.

Referring to FIG. 8 each frame period is divided into a first non-display period (NDP), a display period (DP) and a second non-display period (NDP).

In order to compensate for a DC voltage component in each frame period, each gate electrode is selected or scanned two times, i.e., in the first and second non-display periods, respectively. The first scanning operation is performed for display by applying a display voltage from the source driver and the second scanning operation is performed for DC compensation by applying a DC-compensating pulse having a polarity opposite to that of the display voltage but having an absolute value identical to that of the display voltage.

After the first scanning on all the gate lines in the first non-display period is completed, the backlight is turned "ON" to effect display in the display period and then turned "OFF" in the second non-display period. This is because an optical state of liquid crystal molecules in the compensation period (second non-display period) is independent of the gradational display state due to the asymmetrical V-T curve (with respect to the vertical line (ordinate axis) across the origin) as shown in FIG. 4.

When the liquid crystal device is driven in the above-described manner, it is possible to obtain a high contrast even in the case of changing the operation (ambient) temperature, thus realizing high-quality gradation display.

In the above embodiment, the liquid crystal composition used shows the asymmetrical V-T curve regarding the positive and negative electric fields as shown in FIG. 4. For this reason, a polarity-inversion driving scheme (wherein a polarity of a driving voltage is alternately changed for each frame period to prevent a deterioration in liquid crystal by a DC component of the driving voltage) generally used in a TFT-type liquid crystal device is not applicable to the liquid crystal device of the present invention since the polarity-inversion driving scheme requires an identical transmitted light quantity even in different polarities of the applied voltages at an identical voltage level (as an absolute value).

In the present invention, however, as described above with reference to FIG. 8, for each frame period, the second scanning operation for DC voltage compensation is performed, thus effectively performing compensation for the DC voltage component to prevent the liquid crystal deterioration while realizing a sufficient transmittance and a smooth motion picture display based on the timewise opening rate set to at most 50%.

In place of the anti-ferroelectric liquid crystal, as described above, other liquid crystal materials can also be applicable in the above specific embodiment. For example, the DHF-mode ferroelectric liquid crystal shows a high-speed responsiveness similarly as in the anti-ferroelectric liquid crystal but inherently provides a smaller tilt angle leading to a lower transmittance, thus being suitably used in the present invention.

As described above, according to the present invention, by appropriately using a thresholdless (anti-)ferroelectric liquid crystal material showing an asymmetrical V-T curve in combination with a particular arrangement of a polarizer shifted from the layer normal direction of liquid crystal molecules, it becomes possible to provide a larger contrast and a sufficient transmittance change suitable for gradation display. Further, by the use of temperature control means (including the temperature-detecting means and the temperature-compensating means), a high-quality display state can be retained irrespective of the operation temperature. In addition, by effecting compensation for the DC voltage component, the liquid crystal material used is less deteriorated even in continuous image formation, thus realizing a reliable liquid crystal display apparatus.

What is claimed is:

1. A liquid crystal display apparatus, comprising:

a liquid crystal device comprising a pair of substrates each having thereon an electrode and a liquid crystal disposed between the pair of substrates and providing a tilt angle, driving voltage application means for applying a driving voltage to the liquid crystal, and a pair of polarizers, each of said pair having a polarizing axis, wherein said liquid crystal has a voltage-dependent alignment characteristic such that the tilt angle continuously changes depending on the driving voltage applied to the liquid crystal, and both of said pair of polarizers are disposed so that each polarizing axis is shifted from a position in alignment with an optical axis of the liquid crystal under application of no electric field.

2. An apparatus according to claim 1, wherein the liquid crystal provides a maximum tilt angle max of at least 22.5 degrees and said at least one polarizer is disposed so that the polarizing axis is placed in a position providing a minimum transmittance when the liquid crystal is supplied with a voltage for providing the liquid crystal with a tilt angle of substantially 45 degrees minus max (degrees).

3. An apparatus according to claim 1, wherein the driving voltage application means applies a non-zero voltage to the liquid crystal so that the liquid crystal has an optical axis providing a darkest state based on gradation data providing a minimum transmittance.

4. An apparatus according to claim 3, which further comprises a temperature-detecting device for detecting a temperature of the liquid crystal device and temperature-compensating means for changing the driving voltage depending on the detected temperature.

5. An apparatus according to claim 1, wherein the driving voltage application means applies to the liquid crystal the driving voltage and a voltage identical in absolute value to but opposite in polarity to the driving voltage in one frame period.

6. An apparatus according to claim 5, further including a backlight which is turned on during a display period after the driving voltage is applied and is turned off in said one frame period other than the display period.

7. A liquid crystal display apparatus, comprising:

a liquid crystal device comprising a pair of substrates each having thereon an electrode and a liquid crystal disposed between the pair of substrates and providing a tilt angle, driving voltage application means for applying a driving voltage to the liquid crystal, and a pair of polarizers, each of said pair having a polarizing axis, wherein said liquid crystal has a voltage-dependent alignment characteristic such that the tilt angle continuously changes depending on the driving voltage applied to the liquid crystal, and both of said pair of polarizers are disposed so that each polarizing axis is shifted from a position providing a minimum transmittance under application of no electric field.

8. A liquid crystal display apparatus, comprising:

a liquid crystal device comprising a pair of electrodes and a liquid crystal disposed between the pair of electrodes and providing a tilt angle, driving voltage application means for applying a driving voltage to the liquid crystal, and a pair of polarizers, each of said pair having a polarizing axis, wherein said liquid crystal has a voltage dependent alignment characteristic such that the tilt angle continuously changes depending on the driving voltage applied to the liquid crystal, and wherein each of said pair of polarizers is disposed so that its polarizing axis is shifted from a position in alignment with an optical axis of the liquid crystal in the absence of an electric field.

* * * * *

UNITED STATES PATENT AND TRADEMARK OFFICE

CERTIFICATE OF CORRECTION

PATENT NO. : 6,670,937 B1
DATED : December 30, 2003
INVENTOR(S) : Akira Tsuboyama et al.

It is certified that error appears in the above-identified patent and that said Letters Patent is hereby corrected as shown below:

Column 1,
Line 22, “ten psec” should read -- ten μsec --.

Column 5,
Line 17, “nm-)thick” should read -- nm-thick --.

Signed and Sealed this

Fourteenth Day of September, 2004

JON W. DUDAS
*Director of the United States Patent and Trademark Office*